US006431362B1

(12) United States Patent
Araki et al.

(10) Patent No.: US 6,431,362 B1
(45) Date of Patent: Aug. 13, 2002

(54) APPARATUS AND METHOD FOR PACKAGING UNIT HAVING TONER STORAGE

(75) Inventors: Hiroshige Araki, Yamatokoriyama; Toshihide Ohgoshi; Shigeyuki Wakada, both of Nara; Yoshinori Otsuka, Tenri; Eiichi Kido, Yamatokoriyama, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/559,070

(22) Filed: Apr. 28, 2000

(30) Foreign Application Priority Data

Apr. 28, 1999 (JP) ..... 11-122622

(51) Int. Cl.[7] ..... B65D 81/02
(52) U.S. Cl. ..... 206/588; 206/485
(58) Field of Search ..... 206/320, 216, 206/223, 521, 523, 586, 590–592, 594, 588, 485, 486; 53/467, 474

(56) References Cited

U.S. PATENT DOCUMENTS 3,572,574 A * 3/1971 Mears ..... 206/523
4,828,115 A * 5/1989 Wiegand et al. ..... 206/320
5,226,543 A * 7/1993 Foos et al. ..... 206/592
5,259,508 A * 11/1993 Beckerman ..... 206/594
5,366,080 A * 11/1994 Carstersen et al. ..... 206/523
5,640,651 A 6/1997 Katoh et al.
5,715,940 A * 2/1998 Son ..... 206/320
5,742,883 A 4/1998 Girard et al.
5,761,589 A 6/1998 Kido et al.
5,779,045 A * 7/1998 Yu ..... 206/320
5,794,109 A 8/1998 Ota et al.
6,049,689 A 4/2000 Ishii et al.
6,094,550 A 7/2000 Kido et al.

FOREIGN PATENT DOCUMENTS

JP A7334066 12/1995
JP A1095494 4/1998

* cited by examiner

*Primary Examiner*—Luan K. Bui

(57) ABSTRACT

An object of the invention is to transport safely and reliably a unit such as a developing cartridge in which toner is used, and toner, and to reduce the dimensions and cost of an apparatus for packaging such a unit. Two buffer members are fixed to two opposite widthwise end sides of a developing cartridge, and the resultant combination is accommodated in a packaging box. Each buffer member has a hollow structure formed by blow molding a thermoplastic resin material. The toner is inserted into the interior of each buffer member from an opening thereof, and the buffer members and a non-toner-charged developing cartridge can be packaged together and transported. When the toner in each buffer member is supplied via the opening thereof to the interior of the developing cartridge after the transportation of these parts is completed, a structure in the developing cartridge for preventing the coagulation and leakage of the toner being transported can be simplified, and cost reduction can be effected. Since dead space in the packaging box is effectively utilized for the transportation of the toner, the safety of the transportation and a decrease in cost can be attained.

8 Claims, 9 Drawing Sheets

APPARATUS AND METHOD FOR PACKAGING UNIT HAVING TONER STORAGE

BACKGROUND OF THE INVENTION

1. Field of the Invention

This invention relates to an apparatus and method for packaging a unit having a toner storage, which unit has the possibility of being transported in repetition for the purpose of supplementation and recycling of toner, for use in toner-using image forming apparatuses.

2. Description of the Related Art

In an image forming apparatus, such as a copier, a printer, or a facsimile transfer unit, an electrostatic latent image formed in an electrophotographic manner has heretofore been turned into a clear image by using a powdered developer called toner. A toner image is transferred onto a recording medium, such as paper, and fixed thereto by melting toner by heating the same, whereby the forming of a final image is done. The toner used for the formation of an image is stored in a hopper type container, and used little by little every time an image is formed. After such a number of times of printing processes that is determined on the basis of an amount of toner for one usage and a storage amount thereof have finished, the toner does not substantially remain.

Almost all of image forming apparatuses are provided with a toner hopper capable of re-supplementing a toner cartridge with toner when the toner runs out. However, since the toner is a powdered material, carrying out a toner re-supplementing process is difficult, and, when the toner is spilt over the surrounding area, the latter is soiled by the former. Therefore, an operation for re-supplementing a hopper type container, in which the toner has run out due to the repeated execution of printing processes, with toner has to be carried out by a special technician. This causes the maintenance cost for the image forming apparatus to increase.

In order to solve such problems concerning the toner re-supplementation operation, it is conceived that a unit and all including a toner hopper, a seal assembly, a fixing member, a magnetic roller assembly, a photoconductive drum assembly and a corona assembly be replaced. The designing of such a unit costs comparatively much, and the lifetimes of the magnetic roller assembly, photoconductive drum assembly and corona assembly are considerably long as compared with a consumption rate of the toner. Therefore, forming the unit as a whole of a throwaway type unit which is used only once is wasteful of the materials therefor and a space for the disposal of refuse, and irrational, and the cost of such a unit falls on a consumer, so that the throwaway type unit is not desirable from the viewpoint of the protection of resources and environment currently advocated. In the above-described background, reproducing a toner cartridge, in which the toner has been consumed completely, by replacing only such parts thereof that are worn greatly, for the purpose of reusing or recycling the cartridge; or re-supplementing a toner hopper with toner is attracting technicians' attention as a method having a high efficiency in respect of the expense and a high effectiveness in respect of the protection of environment as compared with throwing away a unit which has become empty and newly purchasing a completely new unit.

On the assumption that a toner cartridge is reused or recycled, the opportunity to necessarily transport not an image forming apparatus as a whole but a toner cartridge or a unit independently increases. Japanese Unexamined Patent Publication JP-A 10-95494 (1998) discloses related techniques for preparing in advance a return package for packaging a toner cartridge and returning the same to a recycling product trader so as to easily carry out such a packaging operation. According to this method of related art, an address is printed in advance on the return package. The resultant return package is folded and stored in a predetermined portion of the inside of a toner cartridge. When it is necessary to return the toner cartridge, the return package stored therein is removed therefrom and unfolded. The toner cartridge is placed in this return package, and then packaged. The resultant return package is sent as it is to the address shown in advance on an outer surface thereof, whereby an operation for returning a toner cartridge is facilitated.

FIG. 8 schematically shows the construction of a packaging apparatus for inserting a developing cartridge 1, in which toner is stored, in a packaging box 2 of a corrugated fiberboard, and supported fixedly at two opposite widthwise end sides thereof on buffer members 3, 4. The buffer members 3, 4 are provided therein with recesses 3*a*, 4*a* in which two opposite widthwise end sides of the developing cartridge 1 are fitted, and the whole of the developing cartridge 1 with the buffer members 3, 4 is placed in the packaging box 2. The developing cartridge 1 is supported at both of the widthwise side portions thereof on the buffer members 3, 4, and accommodated in a hollow of the packaging box 2 with a space left between the developing cartridge 1 and surrounding inner surfaces of the packaging box 2. Therefore, even when an impact is exerted on the packaging box 2 from the outside thereof during the transportation thereof, the impact is weakened by the time the impact reaches the developing cartridge 1, and the occurrence of breakage of the cartridge during the transportation thereof is prevented.

FIG. 9 shows another method of packaging a developing cartridge 1. The parts corresponding to those shown in FIG. 8 are designated by the same reference numerals, and duplicated descriptions thereof are omitted. In order to place the developing cartridge 1 in a packaging box 5, buffer members 6, 7 are arranged on the upper and lower sides of the developing cartridge 1. The buffer members 6, 7 are provided respectively with recesses 6*a*, 7*a* the cross-sectional shapes of which are in conformity with those of upper and lower surfaces of the developing cartridge 1. The whole of a combination of the developing cartridge 1 and buffer members 6, 7 is accommodated in the packaging box 5 with the buffer members 6, 7 fitted around the upper and lower portions of the developing cartridge 1.

Japanese Unexamined Patent Publication JP-A 7-334066 (1995) discloses the techniques of related art for preventing toner in a toner cartridge from being coagulated while the toner cartridge is transported for recycling the same and for other purposes, by rotatably supporting shafts at both of widthwise ends of the toner cartridge so as to enable the toner cartridge to be rotationally moved around the axis thereof by the vibration thereof occurring during the transportation of the same, whereby the coagulation of the toner in the toner cartridge is prevented.

When the packaging apparatuses shown in FIGS. 8 and 9 are used, a developing cartridge 1 can be transported safely and reliably. Such packaging apparatuses are generally used when a product is shipped. When the developing cartridge 1 is once transported to a consumer, the packaging boxes 2, 5 and buffer members 3, 4; 6, 7 are thrown away. However, in order to supplement the developing cartridge 1 with toner for reusing the cartridge 1, and have a cartridge reproducing and re-supplementing trader specialized in the recycling of toner cartridges carry out the reproduction and re-supplementation of the toner cartridge, it is necessary that the developing cartridge 1 be sent to the cartridge reproducing and re-supplementing trader through certain transportation facilities. A cartridge reproducing and re-supplementing trader supplements a used cartridge with new toner after unnecessary toner is removed therefrom, and replaces other worn constituent parts with new parts. Therefore, it is desired that even a used developing cartridge 1 be returned safely with the condition thereof maintained as sound as possible to a cartridge reproducing and re-supplementing trader.

A point in time at which a developing cartridge 1 is returned is a certain period of time after a point in time at which the cartridge was first delivered in a packaged state to a consumer, and packaging boxes 2, 5 and buffer members 3, 4; 6, 7 were already thrown away. Therefore, the user has to purchase suitable packaging and transportation materials, and package the developing cartridge 1 in which the toner has been consumed. Furthermore, the operations for packaging the developing cartridge 1, putting a suitable address on the package thus prepared and sending the package to the addressee rest heavily on the user due to the dimensions and shape thereof and the necessity of determining an addressee of the package, such as a suitable manufacturer or a toner re-supplementing facilities. According to the techniques of related art disclosed in JP-A 10-95494, a return package is folded and stored in a toner cartridge, and unfolded and used as necessary. When the return package is put to use, a burden on the user can be lightened since the address is already shown on the return package. However, it is difficult that a foldable return package sufficiently protects a toner cartridge being transported. Moreover, in an image forming apparatus using toner, the whole of the toner is not always used effectively for image formation in an electrophotographic manner, i.e., both excess toner and toner to be discarded occur. When a used developing cartridge 1 is reproduced or re-supplemented with toner, it is preferable that such waste toner be also disposed of. In the techniques of related art disclosed in JP-A 10-95494, consideration is not given at all to the transportation of waste toner.

When a unit called a developing cartridge or a DV (abbreviation of a developer) cartridge is transported, for example, from a factory to a store or a user, it is placed in a predetermined packaging box and fixed therein by buffer members, the resultant packaging box being transported. In order to reduce the costs of packaging and transportation, it is advantageous that the size of the package is as compact as possible. Therefore, the unit is filled up with toner in advance to be transported. However, there are cases where the toner is coagulated by its own weight or due to vibration or an impact exerted thereon in a lower portion of the interior of the cartridge, or leaks to the outside of the unit. To deal with this problem, it is necessary to insert special seal members in the unit or devise a means for preventing the coagulation of toner. Even when the compactness of a unit packaging box is secured by taking such various measures, buffer members are still required to be inserted in the unit packaging box, and the space in which the buffer members should be inserted additionally is overlooked as a mere dead space. Moreover, an irrational operation, such as packaging and transporting toner alone separately from a unit body is carried out inadvertently to cause the transportation cost to increase.

SUMMARY OF THE INVENTION

An object of the invention is to provide an apparatus and method for packaging a unit having a toner storage which unit is capable of being safely and reliably transported along with toner, accommodated in one and the same package as that of the unit, in order to reduce the transportation cost.

The present invention provides an apparatus for packaging a unit having a toner storage for storing toner to be used in image formation in an electrophotographic manner, comprising:

a packaging box enclosing the unit; and buffer members for fixing and supporting the unit in the packaging box, having a hollow structure to enable the toner to be stored therein.

According to the invention, the unit having a toner storage for storing toner to be used in image formation in an electrophotographic manner is accommodated in the packaging box, and fixedly supported by the buffer members having a hollow structure. The toner can be stored in the hollow structure of the buffer member, and consequently the unit and toner can be accommodated in the same packaging box and transported together. This enables the space in the packaging box to be effectively utilized, and the unit to be safely and reliably transported at a low cost.

According to the invention, the buffer members which support a unit in a packaging box can store toner in a hollow structure thereof. Therefore, the unit can be transported safely and reliably with the toner stored not in the unit but in the buffer member. When the unit is transported with unused toner stored in the buffer member, and, when the unit is charged with the toner from the buffer member after the transportation of the unit is completed, it becomes unnecessary to take measures for preventing the coagulation of the toner during the transportation of the unit and insert a member for preventing the leakage of the toner in the unit. This enables the number of constituent parts and the cost of the unit to be reduced. Since the toner is stored in the interior of the buffer member which is usually dead space, the dead space in the packaging box can be effectively utilized, and the transportation of the unit and toner can be effected safely and reliably at low cost with the compactness of the unit packaging box secured. Since the buffer member is used not only for the purpose of transportation of the unit but also for the purpose of transportation of the toner, the buffer member can be effectively utilized, and contribute to the reduction of cost and the saving of resources.

In the invention it is preferable that the unit is fixedly supported by the buffer members in an opposed state to each other at two opposite widthwise end sides of the unit.

According to the invention, both of the widthwise end sides of the unit are fixedly supported in the packaging box by the buffer members capable of storing toner. This enables the dead space in the packaging box to be effectively utilized, and the transportation of the unit and toner to be effected safely and reliably with the compactness of the unit packaging box size.

According to the invention described above, the widthwise end sides of the unit are fixedly supported by the buffer members, so that in the transportation of the unit, the unit can be protected safely and reliably against an impact from the outside, with the toner stored in the buffer members.

In the invention it is preferable that the unit is fixedly supported by the buffer members in an opposed state to each other at two opposite vertical end portions of the unit.

According to the invention, the unit is fixedly supported by the buffer members provided in the upper and lower portions of the interior of a packaging box, so that the unit can be accommodated in the packaging box safely and reliably. Since the toner can be stored in the buffer members, the transportation of the unit and toner can be carried out with the dead space in the packaging box utilized effectively and with the compactness of the unit packaging box secured.

According to the invention described above, the storage of the toner in the buffering members is effected with the upper and lower portions of the unit fixedly supported by the buffer members. Therefore, the transportation of the toner can be carried out effectively with the unit protected safely and reliably against an external impact.

In the invention it is preferable that the buffer members are formed by a blow molding method using a thermoplastic resin material non-migratory with respect to toner and include an opening for charging the hollow structure with toner and an opening for supplementing the toner storage of the unit with the toner from the hollow structure.

According to the invention, the buffer members are formed by a blow molding method using a thermoplastic resin, so that it is possible to set the capacity of the hollow structures for storing toner therein to a high level and carry out the transportation of toner efficiently. Since the buffer members are formed by using a thermoplastic resin material non-migratory with respect to the toner, the buffer members can be utilized for the transportation of the toner without deteriorating the performance of the toner stored. Since the buffer members have an opening for charging the hollow structure with toner, and an opening for supplementing the toner storage of the unit with the toner from the hollow structures, it is possible to store the toner in the buffer members and transport the same without charging the toner storage of the unit with toner, and supply the toner from the buffer members to the toner storage of the unit after the transportation is completed. Since the buffer members are formed by the blow molding of a thermoplastic resin material, they can be manufactured stably in large quantity at low cost.

In the invention it is preferable that the buffer members are formed by a blow molding method using a thermoplastic resin material non-migratory with respect to toner and include an opening for charging the hollow structure with toner and supplementing the toner storage of the unit with the toner from the hollow structure.

According to the invention, one opening of each buffer member serves as both a charging opening and a supplementing opening. This enables the construction of the buffer members to be simplified, the number of the constituent parts to be reduced by decreasing the number of members required to seal the opening to one, and the manufacturing cost to be thereby reduced.

According to the invention, the opening provided in the buffer members serve as both a charging opening and a supplementing opening. Therefore, only one opening seal member and only one opening covering member may be prepared for each buffer member. This enables the number of the constituent parts to be reduced, and a rational design of the apparatus to be attained at low cost.

In the invention it is preferable that the buffer members can be installed in an image forming apparatus using the unit.

According to the invention, the buffer members can be installed in an image forming apparatus using the unit, so that the buffer members can be left installed in the image forming apparatus until a necessity of transporting the unit in a packaged state for reproduction thereof or recharge with toner occurs.

In the invention it is preferable that the buffer members can be installed as waste toner storage containers in the image forming apparatus.

According to the invention, the buffer members can be installed as waste toner storage containers in the image forming apparatus, so that the waste toner storage containers can be used also as waste toner recovery containers and unused toner transportation containers. This makes it unnecessary to provide space for storing the buffer members, and enables the discarding of waste toner to be done easily.

The invention provides a method an apparatus for packaging a unit having a toner storage for storing toner to be used in image formation in an electrophotographic manner, comprising:

enclosing the unit in a packaging box; and supporting the unit by buffer members having a hollow structure so as to fix the unit in the packaging box, wherein the buffer members are used as transportation containers for unused toner or used toner.

According to the invention, the unit can be supported by the buffer members to be fixed in the packaging box, and transported safely and reliably. During the transportation of the unit, the buffer members of hollow structures are used as transportation containers for unused or used toner. Therefore, the transportation of the unit with toner as well can be carried out by effectively utilizing dead spaces in the packaging box.

In the case of new unit transportation, a new unit can be transported without being charged with toner, with the buffer member in which unused toner is accommodated. After the transportation is completed, the toner from the buffer members can be supplied to the interior of the unit. This makes it unnecessary to take measures for preventing the occurrence of the coagulation and leakage of the toner during the transportation of the unit, and enables the cost to be reduced. When it is necessary to transport a unit for recycle of toner, reproduction of unit or recharge with toner, the buffer members are used as used toner transportation containers, so that a recovery operation in which the disposal of used toner is also carried out by a special trader who carries out the reproduction of the unit and the recharge of the unit with toner becomes easy. Consequently, a burden on a user is reduced, and the transportation of used unit and used toner can be carried out safely and reliably.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
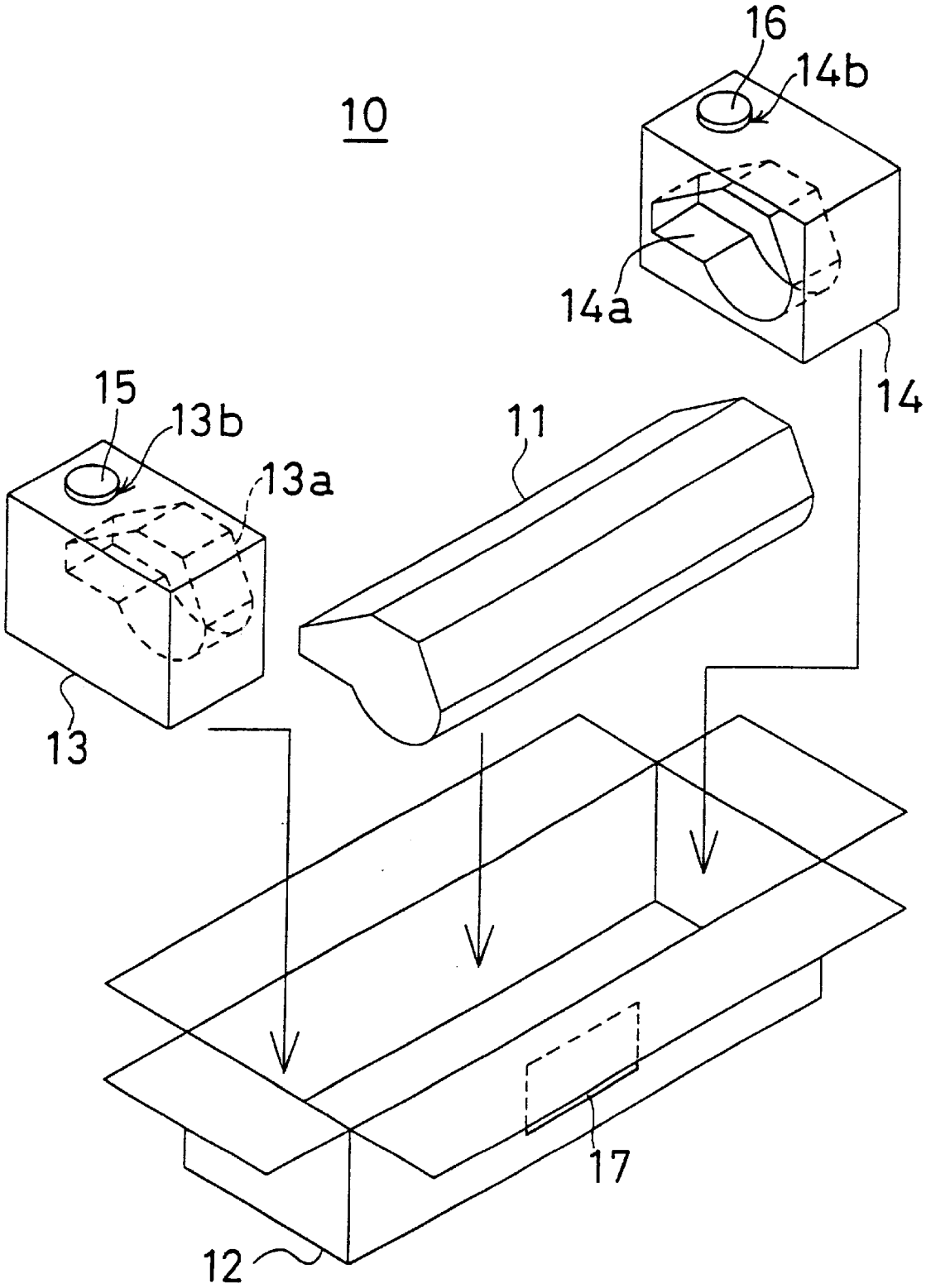
FIG. 1 is an exploded perspective view showing a schematic construction of a mode of embodiment of a packaging apparatus 10 according to the present invention.

Now referring to the drawings, preferred embodiments of the invention are described below.

FIG. 1 shows a schematic construction of a packaging apparatus 10 of a mode of embodiment of the present invention. A developing cartridge 11 for electrophotographic type image forming apparatuses such as copying machines, printers or facsimile apparatuses is accommodated in a packaging box 12 formed of a corrugated board. Buffer members 13, 14 are fitted around two opposite widthwise end sides of the developing cartridge 11, and the resultant developing cartridge 11 is fixedly supported in the interior of the packaging box 12. The buffer members 13, 14 are provided therein with recesses 13*a*, 14*a* the shape of which is in conformity with that of both of sides of the developing cartridge 11 so that the opposite widthwise end sides of the developing cartridge 11 is fitted into the recesses 13*a*, 14*a*, respectively. The developing cartridge 11 and buffer members 13, 14 can be stored in the packaging box 12 in a condition that the opposite widthwise end sides of the developing cartridge 11 are fitted into the recesses 13*a*, 14*a* of the buffer members 13, 14, repectively. The buffer members 13, 14 are formed to hollow structure, and can store toner therein. Openings 13*b*, 14*b* are provided in the buffer members 13, 14 so as to charge the interior of the buffer members 13, 14 with toner, or re-supplement the developing cartridge 11 with the toner with which the buffer members are charged. The openings 13*b*, 14*b* are sealed with covering members 15, 16. The packaging box 12 is pasted a label 17 indicating the destination such as an addressee on the surface thereof.

Figure 2:
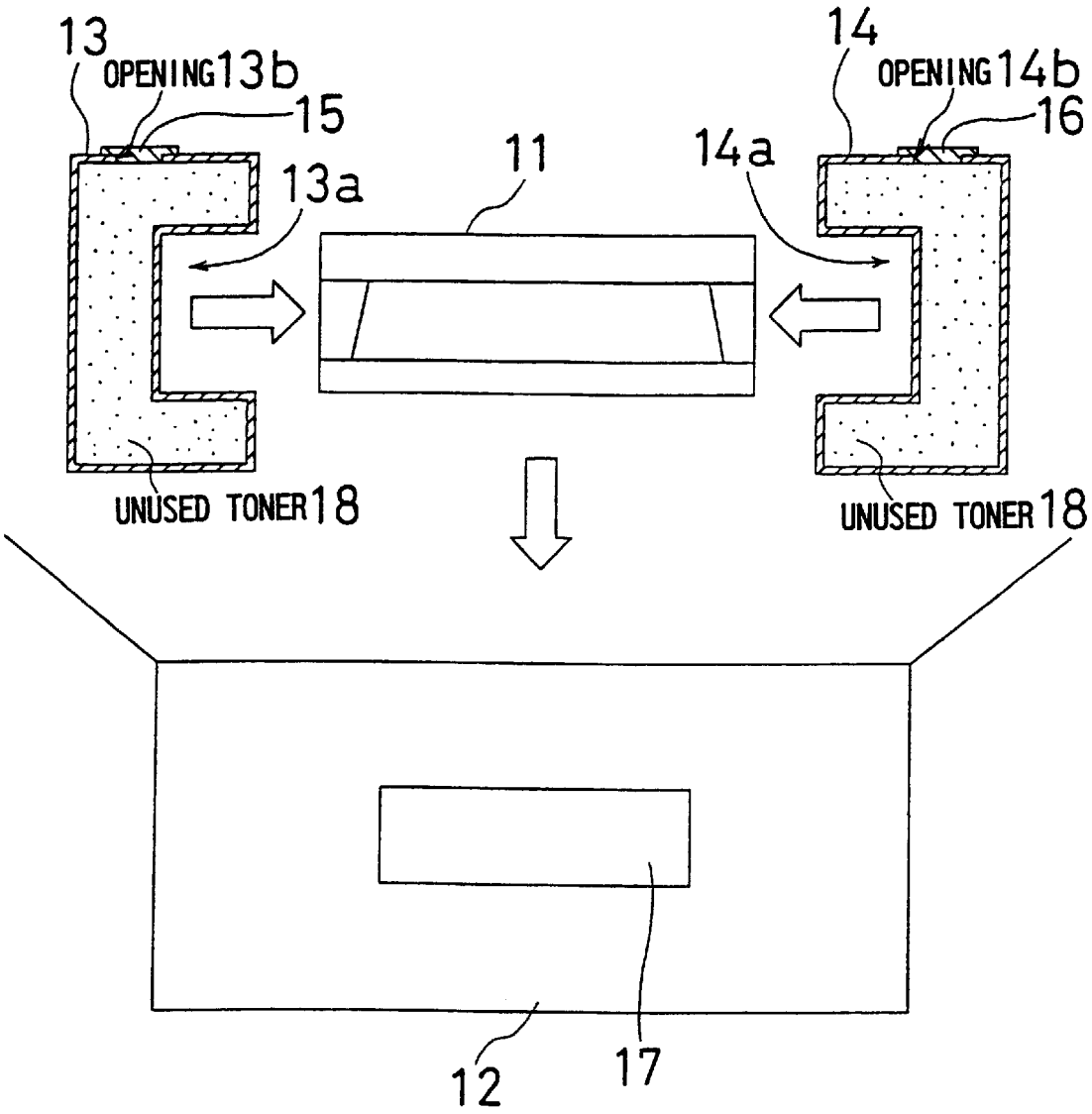
FIG. 2 is a sectioned front elevation showing the condition of buffer members 13, 14 charged with unused toner 18, and a unit being packaged by using the packaging apparatus 10 of FIG. 1.

FIG. 2 shows the condition of a new developing cartridge 11 being packaged by using the same packaging apparatus 10 as shown in FIG. 1. Buffer members 13, 14 charged with unused toner 18 therein are fitted around two opposite widthwise end sides of the developing cartridge 11, and the resultant combination as a whole is accommodated in a packaging box 12. Since the buffer members 13, 14 are charged with the unused toner 18, the developing cartridge 11 does not require to be charged with toner. The developing cartridge 11 and toner are accommodated in the same packaging box 12, and can be transported at once from a factory to a store or a user.

Figure 8:
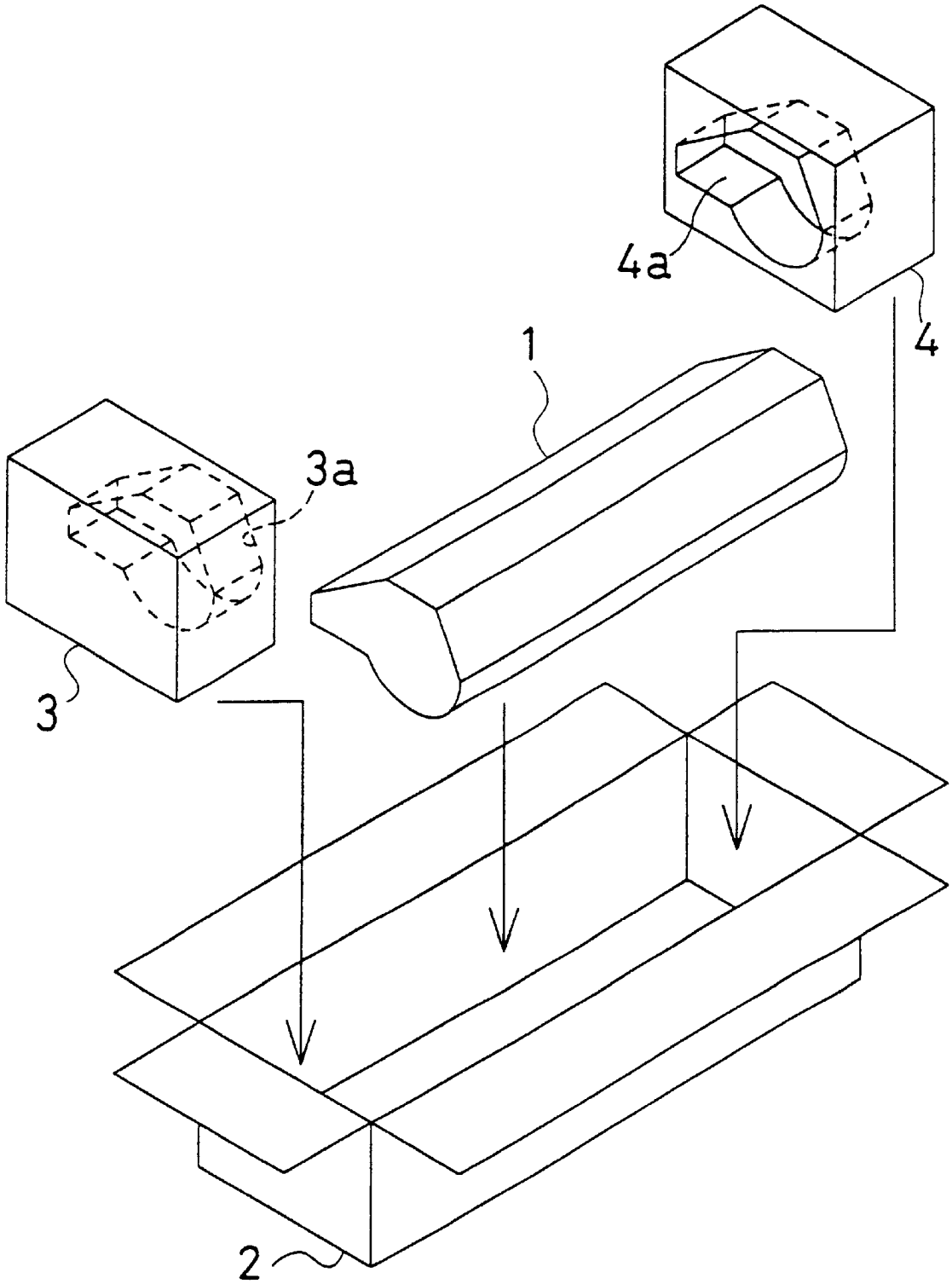
FIG. 8 PRIOR ART
FIG. 8 is an exploded perspective view showing the condition of an example of a developing cartridge 1 being packaged of the related art.
Figure 9:
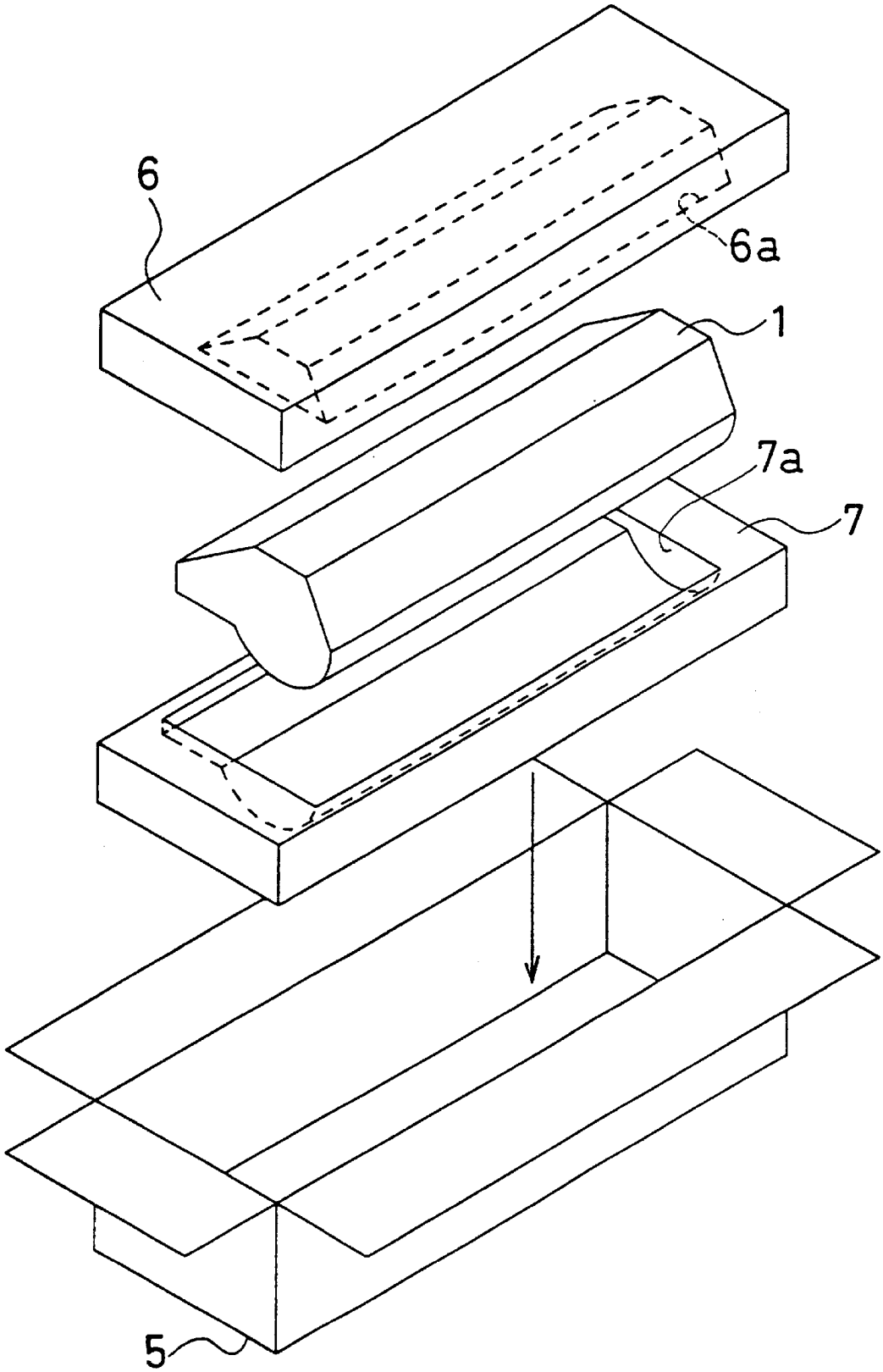
FIG. 9 PRIOR ART
FIG. 9 is an exploded perspective view showing the condition of another example of a developing cartridge 1 being packaged of the related art.

Since such buffer members 3, 4; 6, 7 of the related art as shown in FIGS. 8 and 9 are formed of styrofoam or a layered and pasted corrugated board, they can be used only for transporting a developing cartridge 1, and, moreover, these buffer members constitute dead spaces, which do not contribute directly to the transportation operation, in packaging boxes 2, 5. Since the buffer members 13, 14 in this mode of embodiment store the unused toner 18 therein, and can be transported with the developing cartridge 11, a tilting force and an impact which the developing cartridge 11 receives during the transportation thereof are absorbed, so that the safe transportation of the unit and toner can be attained. When the packaging box 12 is opened so as to use the unit, such as the developing cartridge 11, the developing cartridge 11 is charged with the unused toner 18, which has been stored in the buffer members 13, 14 and transported to an object place, by opening the covering members 15, 16 for the openings 13*b*, 14*b*, and then can be utilized for an image forming apparatus. Since the developing cartridge 11 does not contain toner during the transportation thereof, the measures to be taken for the prevention of the coagulation and leakage of toner and the cost of the unit can be reduced.

In this mode of embodiment, the buffer members 13, 14 are provided with a function of devices for protecting the developing cartridge 11, and that of toner transporting containers. The function of the buffer members 13, 14 as toner transporting containers is attained by forming the buffer members 13, 14 to hollow structures. In order to obtain hollow structures, a thermoplastic resin is used as a raw material for the buffer members 13, 14. The thermoplastic resin is preferably formed of a material selected from polyethylene resin and the like in view of the gas isolating characteristics and mechanical strength of containers finally obtained, and the moldability of the material. As a molding method, a blow molding method is preferably employed so as to obtain a high productivity of the hollow structures. As a raw material for forming the buffer members 13, 14, not only polyethylene but also a thermoplastic resin capable of being used as an injection molding material, such as polypropylene can be used. Not only a blow molding method but also an injection molding method can be used. It is necessary that a resin material used is non-migratory with respect to the toner. When a resin material is non-migratory, the buffer members formed of such a resin material can be used as transportation containers without exerting influence upon the property of the toner. This can prevent toner of a certain composition from decomposing and deteriorating the buffer members 13, 14 as containers, and the content of the buffer members from leaking therefrom and contaminating the surroundings.

The buffer members 13, 14 are provided suitably with openings 13*b*, 14*b* for supplementing the developing cartridge 11 with toner. These openings 13*b*, 14*b* can also be used for charging the buffer members 13, 14 with toner at the toner charging time during a unit manufacturing step. When the buffer members 13, 14 are used only once as toner containers, the covering members 15, 16 do not have to be provided on the openings 13*b*, 14*b*. The openings 13*b*, 14*b* are sealed by heat at the toner charging time in a factory. When the buffer members are used, the openings are opened by removing seal portions, whereby the cost can be reduced.

Figure 3:
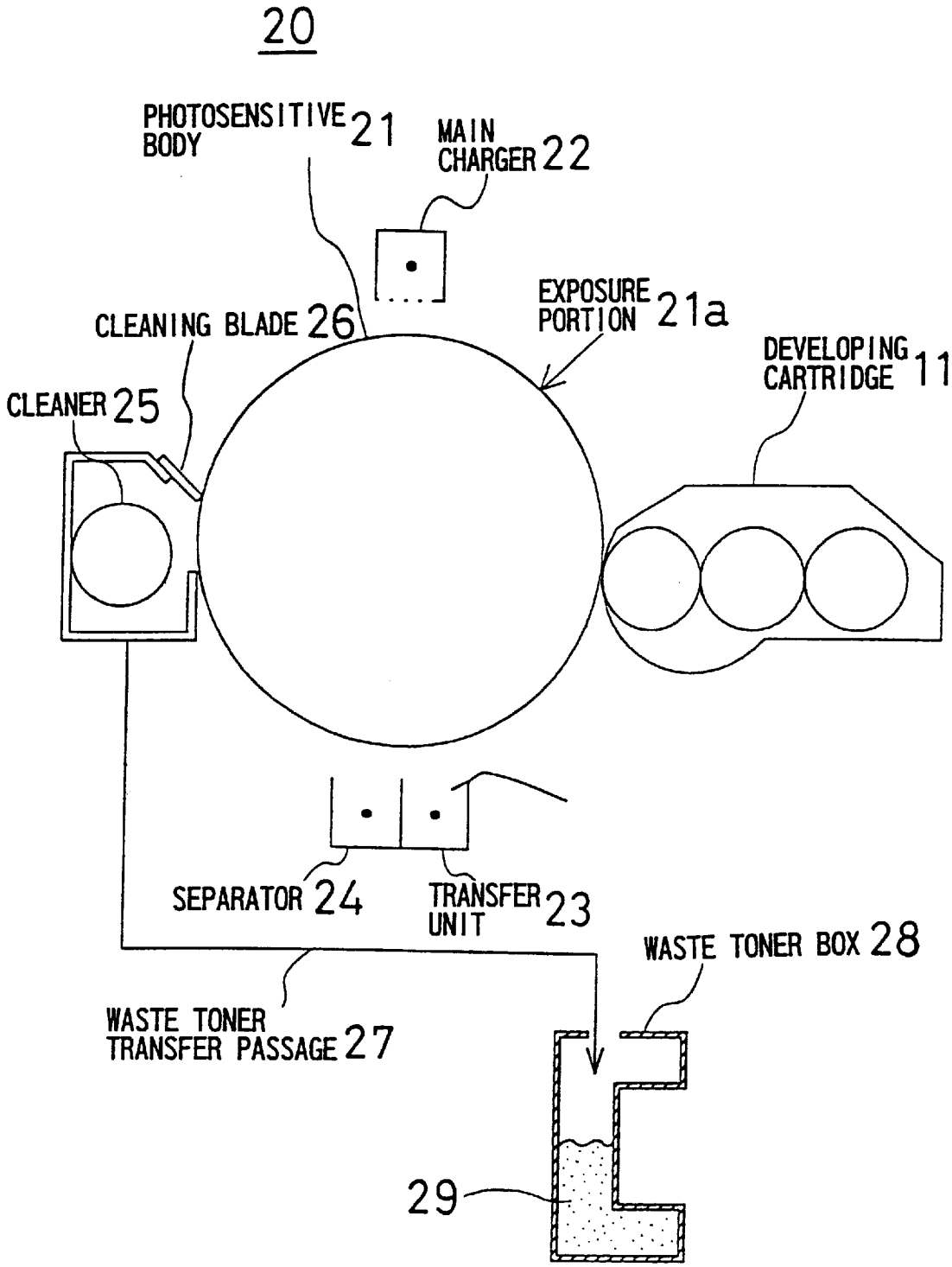
FIG. 3 is a simplified sectional view showing a principal portion of an image forming apparatus 20 in which a developing cartridge 11 of FIG. 1 is incorporated.

FIG. 3 shows the condition of a developing cartridge 11 packaged as shown in FIG. 2 and used practically, by incorporating the same cartridge in an electrophotographic type image forming apparatus 20. The image forming apparatus 20 is provided with a drum type photosensitive body 21, and exposure for forming an image on an exposure portion 21*a* is carried out, an electrostatic latent image being thus formed. The toner is supplied onto the electrostatic latent image from a developing cartridge 11, and the latent image is thereby developed to obtain a toner image. An outer surface of the photosensitive body 21 is formed of a photoconductor, and a main charger 22 for uniformly charging the surface of the photosensitive body 21 is provided in a position on the upstream side of the exposure portion 21*a* in the rotational direction of the photosensitive body 21. A transfer unit 23 is provided in a position near the portion of the photosensitive body 21 which is on the downstream side of the developing cartridge 11. The transfer unit 23 is adapted to transfer the toner image formed on the surface of the photosensitive body 21 onto a surface of a recording medium, such as paper by electrically attracting the former onto the latter. A separator 24 is adapted to separate the recording medium from the surface of the photosensitive body 21. A cleaner 25 is adapted to clean the surface of the photosensitive body 21 by scraping off by a cleaning blade 26 the residual toner not transferred onto the surface of the photosensitive body 21. The toner scraped off is guided to a waste toner box 28 via a waste toner transfer passage 27. The waste toner box 28 stores waste toner 29 therein.

The buffer members 13, 14 in this mode of embodiment can be utilized as the waste toner boxes 28 shown in FIG. 3. When the buffer members 13, 14 are utilized as the waste toner boxes 28, spaces necessary for storing the buffer members 13, 14 can be reduced. When the buffer members 13, 14 not utilized as the waste toner boxes 28 are stored in a special fixing portion provided in the image forming apparatus, the re-utilizing thereof is done easily. The packaging box 12 can be stored in a folded state.

Figure 4:
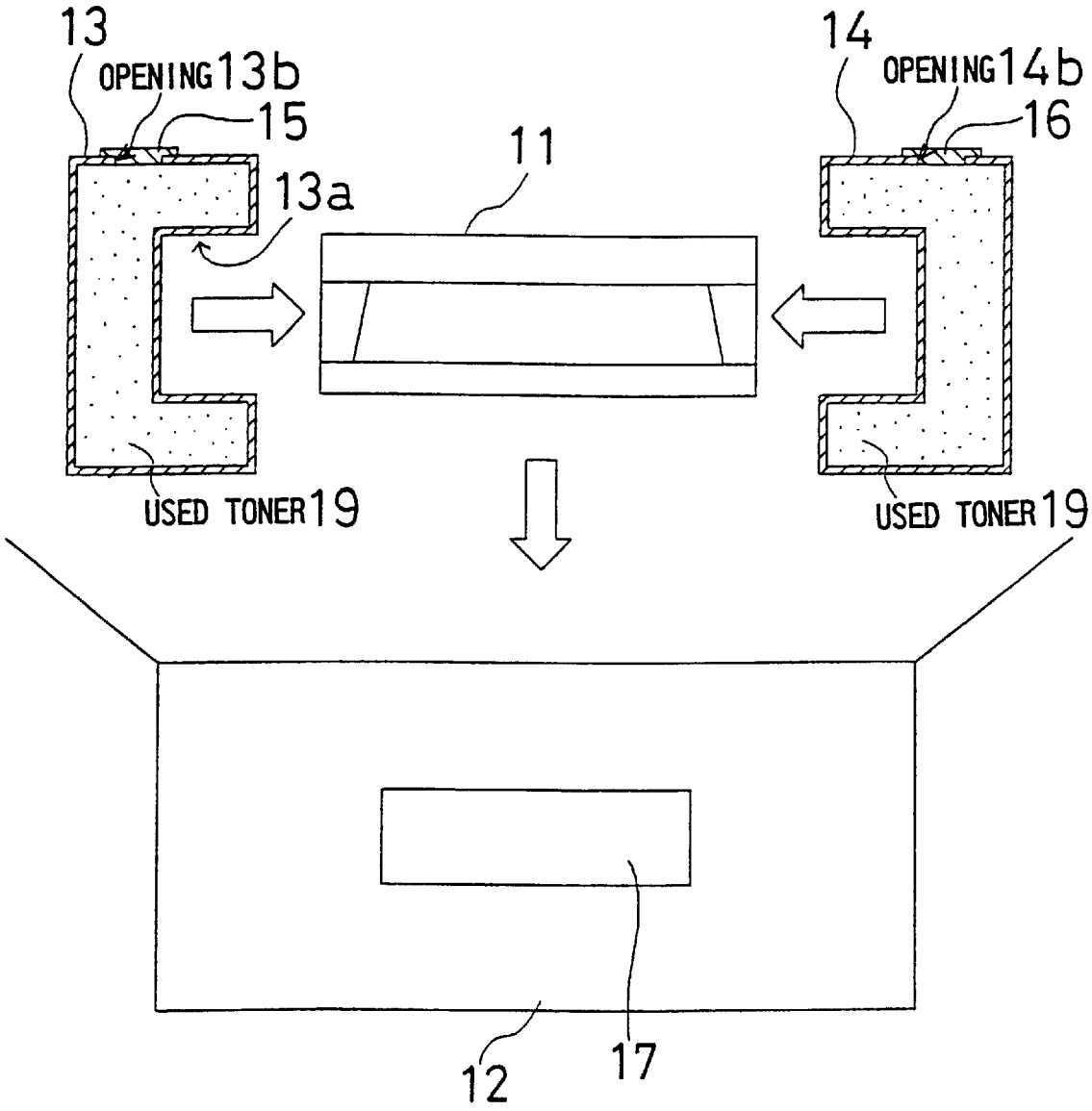
FIG. 4 is a sectioned front elevation showing the condition of the buffer members 13, 14 charged with used toner 19, and a unit being packaged by using the packaging apparatus 10 of FIG. 1 for the reproduction of the developing cartridge 11 or the re-supplementation thereof with toner.

FIG. 4 shows the condition of a developing cartridge 11 being packaged so as to return the developing cartridge 11 for the reproduction thereof or the re-supplementation thereof with toner. The buffer members 13, 14 are used as the waste toner boxes 28 of FIG. 3, in which accumulated waste toner 29 is stored as used toner 19. Accordingly, it does not take time to dispose of the waste toner 28 of FIG. 3, and the unit, such as used developing cartridge 11 and waste can be returned easily to a reproduction and re-supplementation trader without causing the waste to be dissipated. Between the condition of FIG. 2 and that of FIG. 4, remarkable deformation of and damage to the buffer members 13, 14 and developing cartridge 11 do not occur unless these parts are intentionally destroyed. Therefore, the buffer members and developing cartridge are easily accommodated in the packaging box 12, and the buffer members 13, 14 function as a transportation containers for the used toner 19 during the transportation of these parts for returning the same to the trader. This enables the unit and toner to be transported safely and reliably to the reproduction and re-supplementation trader and recovered.

Figure 5:
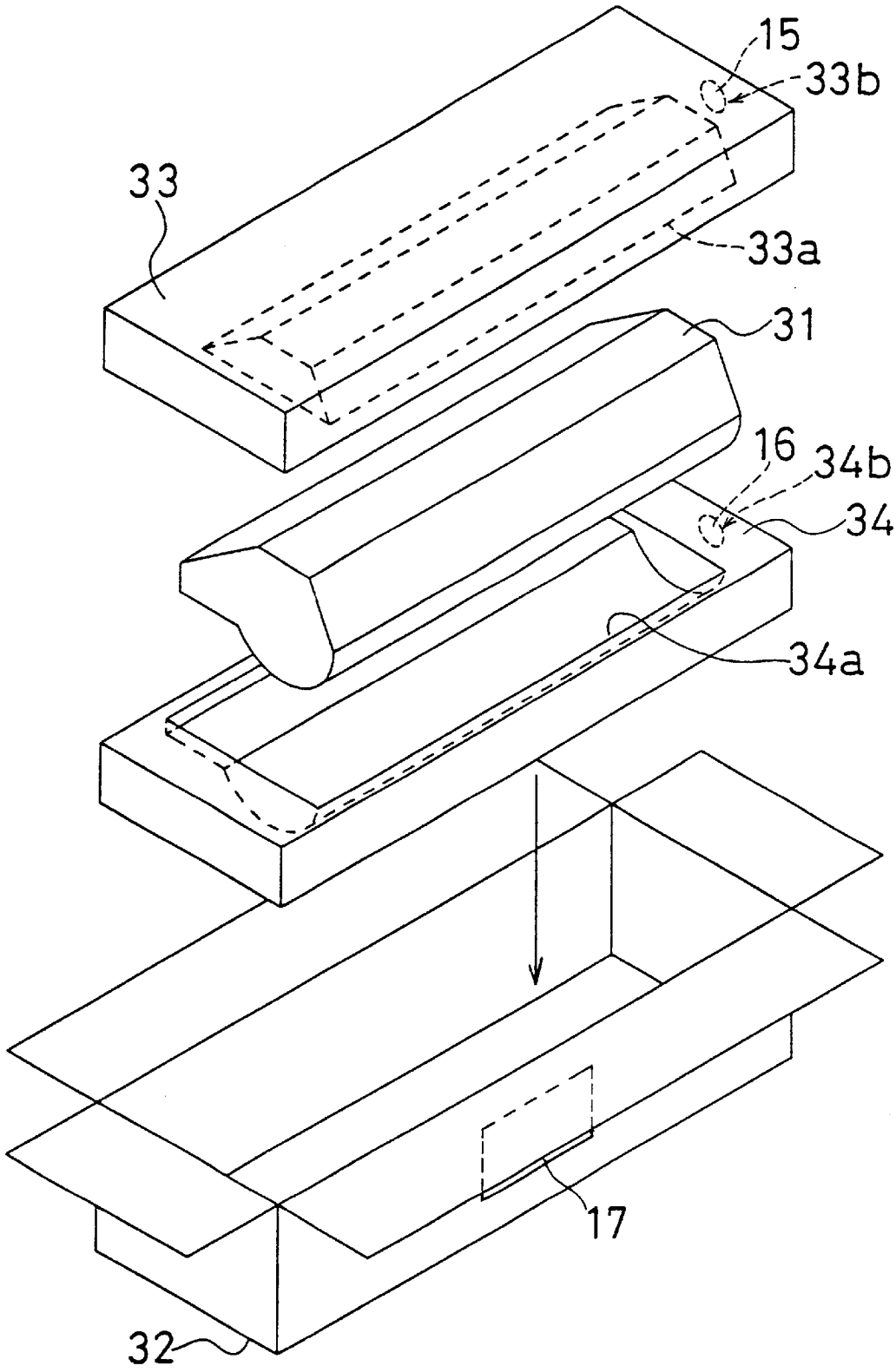
FIG. 5 is an exploded perspective view showing the schematic construction of a packaging apparatus 30 of another mode of embodiment of the present invention.
Figure 6:
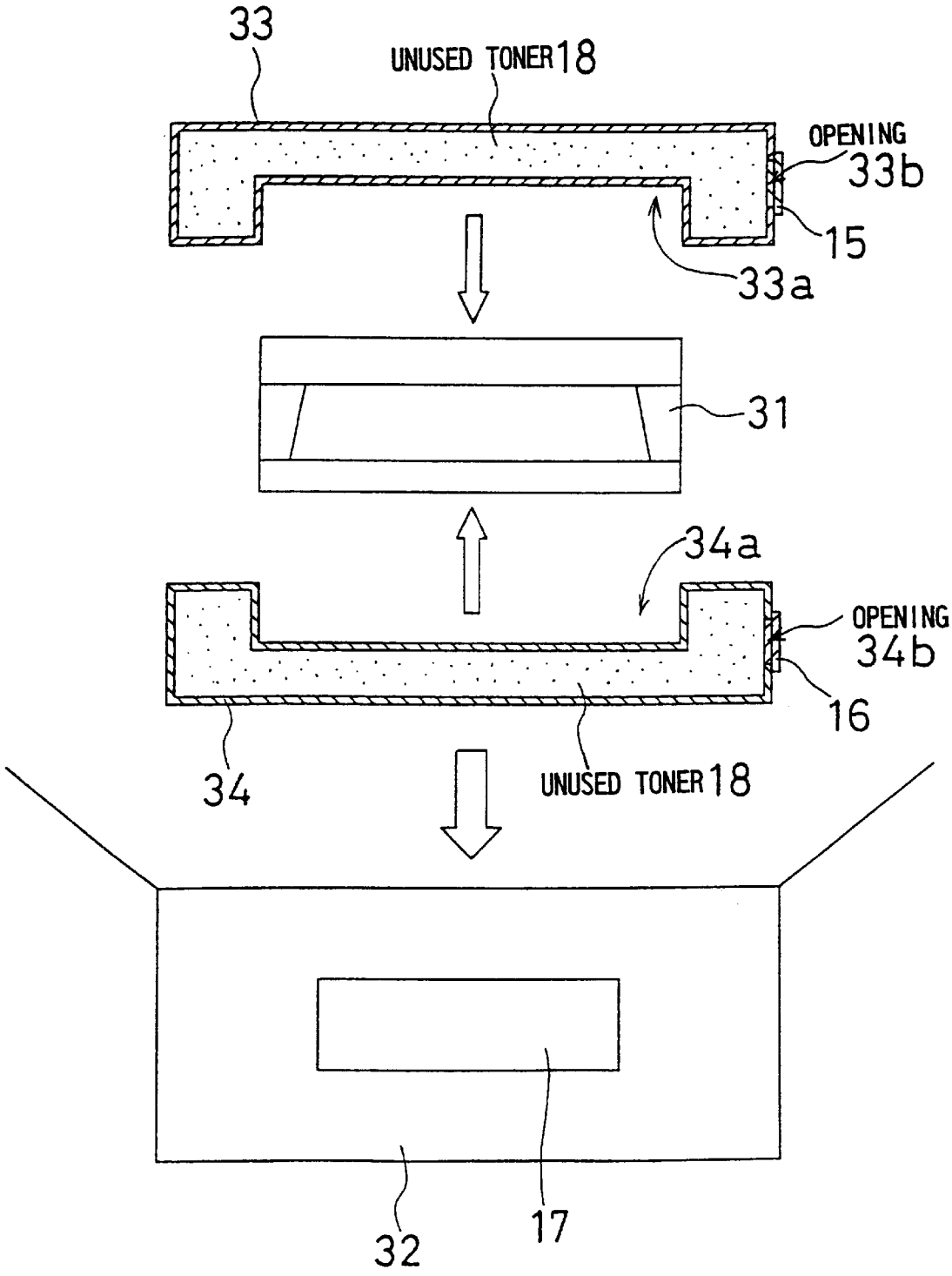
FIG. 6 is a sectioned front elevation showing the condition of buffer members 33, 34 charged with unused toner 18, and a unit being packaged by using the packaging apparatus 30 of the mode of embodiment of FIG. 5.
Figure 7:
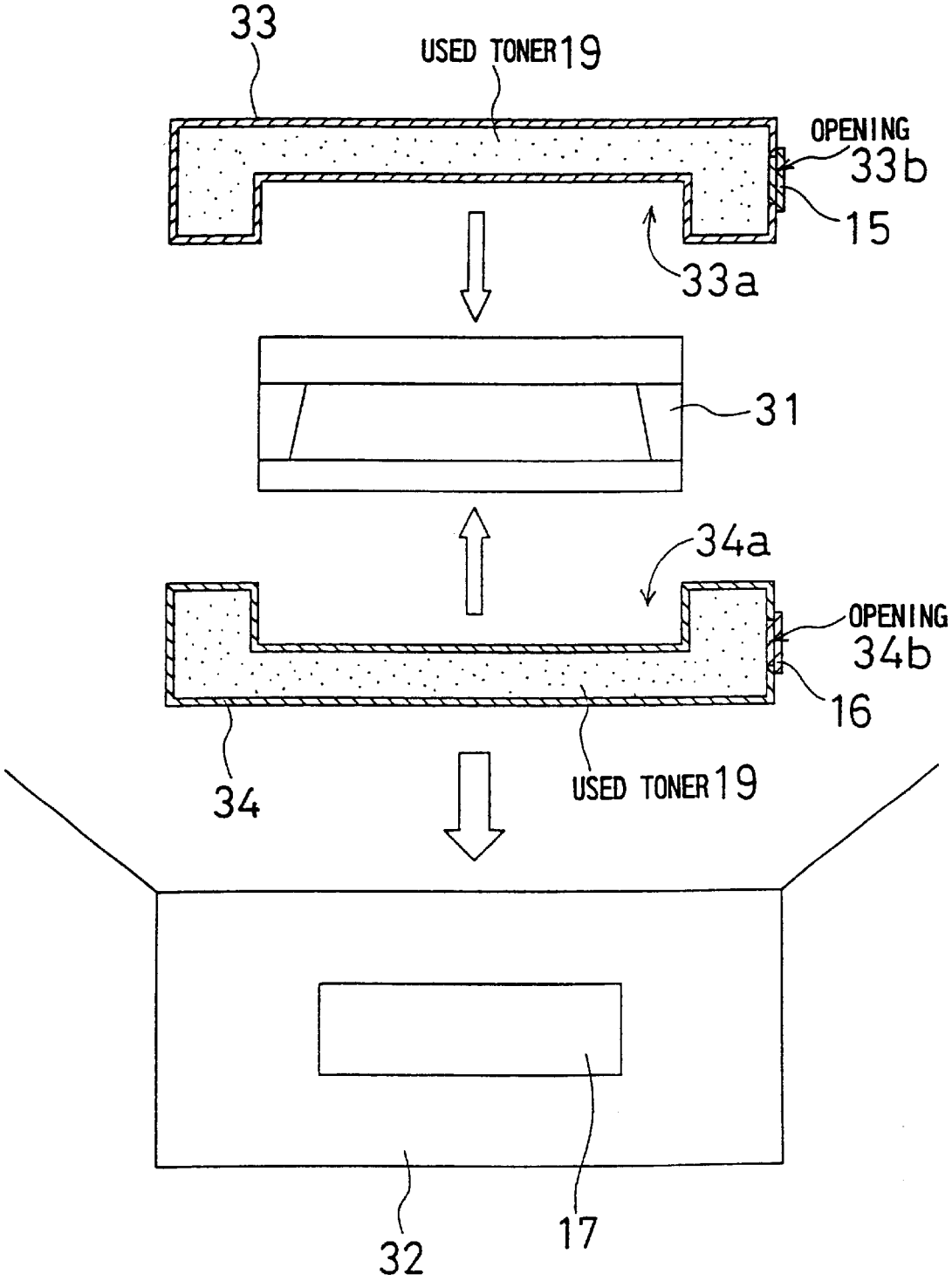
FIG. 7 is a sectioned front elevation showing the condition of the buffer members 33, 34 charged with used toner 19, and a unit identical with that in the mode of embodiment of FIG. 5, which is being packaged for the reproduction of a developing cartridge 31 or the re-supplementation thereof with toner.

FIGS. 5, 6 and 7 show the schematic construction of a packaging apparatus 30 in still another mode of embodiment of the present invention. The parts corresponding to those of the mode of the embodiment of FIG. 1 are designated by the same reference numerals, and duplicated descriptions thereof are omitted. FIG. 5 shows the condition of a unit being packaged, FIG. 6 the condition in section of the unit not yet used which is being packaged, and FIG. 7 the condition in section of the unit already used which is being packaged for the reproduction thereof or the re-supplementation thereof with toner. When the developing cartridge 31 in this mode of embodiment is placed in the packaging box 32, the upper and lower portions of the former are fixedly supported by the buffer members 33, 34 in the same manner as in the case of the packaging apparatus shown in FIG. 9. The buffer members 33, 34 are provided with recesses 33*a*, 34*a* the shape of which is in conformity with that of the upper and lower surfaces of the developing cartridge 31, and the developing cartridge 31 can be accommodated with the buffer members 33, 34 fixed to the upper and lower portions thereof in the packaging box 32. The buffer members 33, 34 are also formed to hollow structures by blow molding a thermoplastic resin material in the same manner as the buffer members 13, 14 of FIG. 1, and unused toner 18 or used toner 19 can be stored therein via the openings 33*b*, 34*b*. During the storage of the toner, the openings 33*b*, 34*b* are sealed with the covering members 15, 16 so that the unused toner 18 or used toner 19 in store does not leak to the outside. The storage of the packaging box 32 and buffer members 33, 34 can be carried out in the same manner as in the mode of the embodiment of FIG. 1.

According to the modes of embodiment described above, the openings 13*b*, 14*b*; 33*b*, 34*b* are provided in one portion of the buffer members 13, 14; 33, 34, and used both for charging the developing cartridges 11, 31 with unused toner 18 or used toner 19, and for supplementing the developing cartridge 11, 31 with unused toner 18 but the openings for charging the buffer members with toner and openings for supplementing the buffer members with toner can also be provided separately. When a method of providing these openings separately is employed, the openings can be provided in the portions of the buffer members which permit the work of forming the openings to be carried out easily. The buffer members can also be divided into parts and used in four corner portions of a rectangular parallelopipedal packaging box.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A packaging structure for a unit, the packaging structure for storing toner to be used in image formation in an electro photographic manner, comprising:

a packaging box of sufficient size to contain the packaging structure; and buffer members for fixing and supporting the unit in the packaging box, at least one buffer member having a hollow structure storing toner therein, wherein said at least one buffer member has an opening for charging said at least one buffer member with the toner.

2. The apparatus of claim 1, wherein the buffer members are at two opposite widthwise end sides of the unit.

3. The apparatus of claim 1, wherein the buffer members are at two opposite vertical end portions of the unit.

4. The apparatus of claim 1, wherein the buffer members are formed of a blow molded thermoplastic resin material non-migratory with respect to toner and include an opening for charging the hollow structure with toner and an opening for supplementing the toner storage of the unit with the toner from the hollow structure.

5. The apparatus of claim 1, wherein the buffer members are formed of a blow molded thermoplastic resin material non-migratory with respect to toner and include an opening for charging the hollow structure with toner and supplementing the toner storage of the unit with the toner from the hollow structure.

6. The apparatus of claim 1, wherein the buffer members can be installed in an image forming apparatus using the unit.

7. The apparatus of claim 6, wherein the buffer members can be installed as waste toner storage containers in the image forming apparatus.

8. A method for packaging a unit in a packaging structure having a hollow structure for storing toner to be used in image formation in an electro photographic manner, comprising:

supporting the unit by buffer members having the hollow structure, charging the hollow structure with the toner; and enclosing the buffer members and the unit in a packaging box, wherein the buffer members are used as transportation containers for unused toner or used toner.

* * * * *